United States Patent [19]

Sakano

[11] Patent Number: 4,605,044

[45] Date of Patent: Aug. 12, 1986

[54] TAKEUP MOTION CONTROL DEVICE FOR LOOMS

[75] Inventor: Toshiyuki Sakano, Kanazawa, Japan

[73] Assignee: Tsudakoma Corp., Kanazawa, Japan

[21] Appl. No.: 704,682

[22] Filed: Feb. 22, 1985

[30] Foreign Application Priority Data

Feb. 24, 1984 [JP] Japan ..... 59-032572

[51] Int. Cl.[4] ..... D03D 49/20

[52] U.S. Cl. ..... 139/304; 139/1 E; 139/99; 66/210

[58] Field of Search ..... 139/99, 308, 307, 304, 139/309, 311, 310, 1 E; 66/210, 149 R; 364/470

[56] References Cited

U.S. PATENT DOCUMENTS 4,430,870 2/1984 Winter ..... 66/210

FOREIGN PATENT DOCUMENTS 44-28270 11/1969 Japan .

59-82451 5/1984 Japan ..... 139/304

*Primary Examiner*—Henry S. Jaudon

*Attorney, Agent, or Firm*—Flynn, Thiel, Boutell & Tanis

[57] ABSTRACT

A takeup motion control device for a loom includes an input setting unit for producing functions of a repetitive period and a takeup speed, a function generator for storing the functions in relation to r.p.m. of the loom, an arithmetic control unit for successively reading out the selected functions from the function generator in synchronism with rotation of the loom to generate a digital takeup command signal, a driver circuit for generating a drive signal in response to the takeup command signal and applying the drive signal to a servomotor for driving a winding roll to wind a woven fabric, and a digital feedback circuit for feeding an amount of rotation of the servomotor back to the arithmetic control unit.

12 Claims, 5 Drawing Figures

TAKEUP MOTION CONTROL DEVICE FOR LOOMS

BACKGROUND OF THE INVENTION

1. Field of the Invention:

The present invention relates to a takeup motion control device for varying the speed of winding up a woven fabric periodically or according to a desired speed pattern.

2. Description of the Prior Art:

Woven fabric takeup movement in a loom has to be effected in synchronism with the operation of the loom. The rotative power for operating the loom is normally reduced in speed so as to be available as rotative power for a takeup roll.

Weft yarn as it is interwoven with warp yarn is beaten by a reed up against the fell. The density of weft yarn picks inserted is dependent on the speed of winding up the fabric as it is successively woven. Therefore, the weft yarn density tends to vary as the speed of winding up the woven fabric varies.

Japanese Laid-Open Utility Model Publication No. 53-69577 discloses that in weaving a pile fabric, the weft yarn density can be varied in a pile fabric portion and other woven fabric portions by selecting one of two gear ratios for a takeup motion. With this prior art, however, the gear ratios cannot continuously be changed, and hence it is almost impossible to vary the weft yarn density continuously or periodically according to a desired repetitive pattern.

SUMMARY OF THE INVENTION

Therefore, it is an object of the present invention to provide a takeup motion control device capable of periodically varying the density of weft yarn picks during operation of the loom.

Another object of the present invention is to provide a takeup motion control device for varying the speed of winding up a woven fabric based on a desired speed pattern.

The present invention is based on the digital rotation control of a servomotor. In addition to a drive motor for a loom, there is provided a servomotor for a takeup motion, and the speed and amount of rotation of the servomotor are held in synchronism with rotation of the loom and are periodically varied. Such periodic variation of the speed of winding up a woven fabric will appear as periodic variation of the density of weft yarn picks. The degree of variation is previously introduced and stored in a control system as a pattern of rotational speeds of the servomotor. A desired pattern of fabric-winding speed can be established according to the stored pattern. According to the present invention, an optimum fabric-winding speed can be achieved by giving a suitable rotational speed of the servomotor for winding up the woven fabric when the weft yarn is to be restored or the loom is to be restarted.

As a result, the present invention has the following advantages:

First, a takeup servomotor is provided other than a loom driving motor, and a rotational speed of the servomotor can be set independently of the loom driving motor. Therefore, the density of weft yarn picks can be changed simply and continuously during operation of the loom.

Secondly, the weft yarn density can be established in relation to a desired repetitive pattern (of periods or waveforms). For a multicolor loom, the densities of weft yarns employed can independently be varied, thus producing a woven fabric of varying densities, which has conventionally been impossible to accomplish.

A third advantage is that the takeup motion can be reversed for an accurate interval at the time of restarting the loom or restoring the weft yarn. Therefore, the fell can be set to a proper position to prevent a weaving bar, especially a stop mark, from being produced in the woven fabric. This advantage is effective in improving the quality of woven fabrics.

As a fourth advantage, the woven fabric and weft yarn can be fed along or returned by operating an electric switch rather than operating a handle as has been conventional. Therefore, loom maintenance and other operations required for servicing the loom can be reduced.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
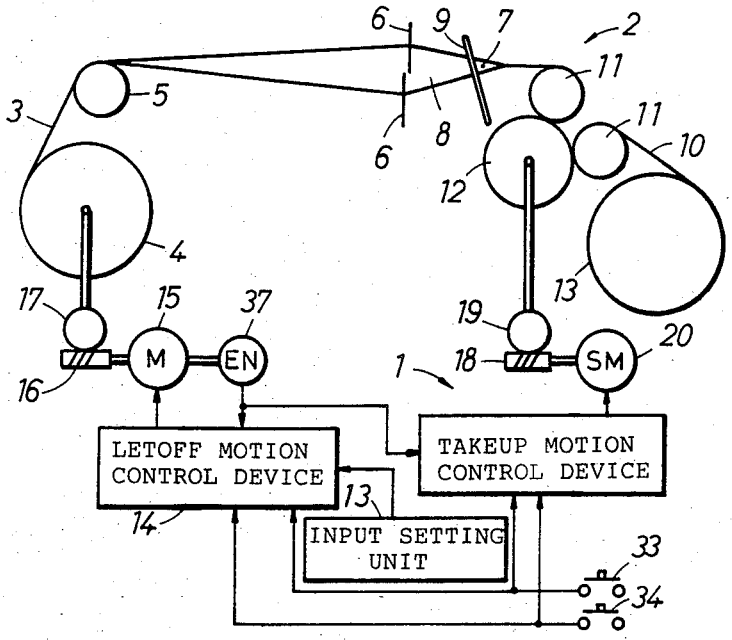
FIG. 1 is a schematic diagram of a loom.

FIG. 1 shows a takeup motion control device 1 in relation to a portion of a loom 2. Warp yarns 3 are supplied from a supply beam 4 over a feed roll 5 and are separated by healds 6 to form a shed 8. The warp yarns 1 are woven with a weft yarn 7 at a fell, the weft yarn 7 being beaten by reed 9 up against the fell to form a woven fabric 10. The woven fabric 10 is then delivered in contact with two rolls 11 and a winding roll 12 and is then wound around a takeup beam 13.

The supply beam 4 is controlled by a letoff motion control device 14. More specifically, the letoff motion control device 14 controls the amount of rotation of a letoff motion motor 15 while detecting the tension of the warp yarns 3 and the diameter of the warp yarn coil on the supply beam 4. Rotation of the letoff motion motor 15 is transmitted via a worm 16 and a worm gear 17 to the supply beam 4.

The winding roll 12 is driven by a takeup servomotor 20 which is controlled in rotation by the takeup motion control device 1 according to the present invention. Rotation of the servomotor 20 is reduced in speed by a worm 18 and a worm gear 19 and then transmitted to the winding roll 12. The worm speed reducer mechanism is effective in preventing rotation of the winding roll 12 when the loom 2 is stopped.

Figure 2:
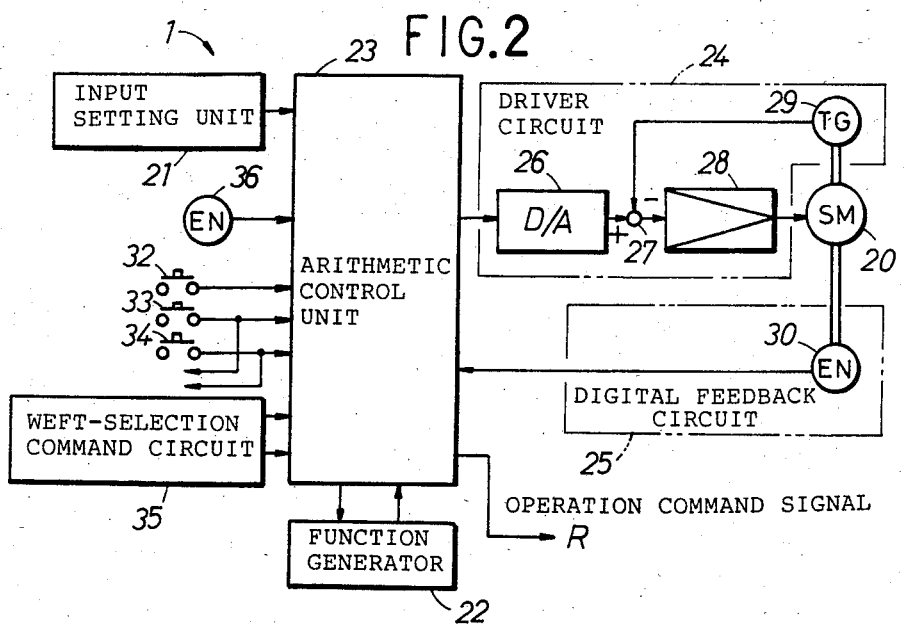
FIG. 2 is a block diagram of a takeup motion control device according to the present invention.

FIG. 2 shows an arrangement of the takeup motion control device 1 of the invention.

The takeup motion control device 1 has an arithmetic control unit 23 including a central processing unit (CPU) which is connected through input terminals to an input setting unit 21 and an encoder 30 of a digital feedback circuit 25, through ouput terminals to a driver circuit 24, and through input and output terminals to a function generator 22. The driver circuit 24 comprises a D/A converter 26, an adding point 27, and a driver amplifier 28 connected in series between the arithmetic control unit 23 and the servomotor 20 for the takeup motion, and also includes a tachogenerator 29 mechanically coupled to the servomotor 20 and electrically connected to the adding point 27. The encoder 30 of the digital feedback circuit 25 is mechanically coupled to the servomotor 20 and electrically connected to an input terminal of the arithmetic control unit 23.

The arithmetic control unit 23 has other input terminals connected to an operation switch 32, a one-revolution command switch 33, a one-pick-return command switch 34, a weft-selection command circuit 35, and an encoder 36 for detecting rotation of the loom 2.

Operation of the takeup motion control device 1 will be described hereinbelow.

First, the operator manipulates the input setting unit 21 to supply the data of weaving conditions such as r.p.m. N of the loom 2 and the density D of weft yarn picks to the arithmetic control unit 23. Based on the supplied data, the arithmetic control unit 23 computes a rotational speed of the servomotor 20 or a fabric-winding or takeup speed V, and stores the computed speed as a speed pattern in the function generator 22 in relation to the r.p.m. N of the loom 2. Thereafter, the operator actuates the operation switch 32 to give an operation command. The arithmetic control unit 23 then generates an operation command signal R for the loom 2, which now starts weaving operation. As the weaving operation progresses, the letoff motion control unit 14 rotates the letoff motion motor 15 in relation to the diameter of the coil of the warp yarns 3 on the supply beam 4, for thereby feeding a required length of the warp yarns 3 from the supply beam 4, while continuously maintaining the warp yarns 3 under prescribed tension.

The takeup motion control device 1 detects the r.p.m. of the loom 2 with the encoder 36, and controls the rotational speed of the servomotor 20 based on the prescribed speed pattern in synchronism with the rotation of the loom 2. More specifically, the arithmetic control unit 23 is supplied with a signal indicative of the rotation of the loom 2 from the encoder 36, and reads the data of the rotational speed from the function generator 22 and applies the read data as a digital signal to the driver circuit 24. The D/A converter 26 in the driver circuit 24 converts the supplied digital signal into an analog signal which is fed through the adding point 27 to the driver amplifier 28. The driver amplifier 28 is responsive to the supplied drive signal to control the rotation of the servomotor 20. The rotation of the servomotor 20 is converted by the tachogenerator 29 into an electric signal, which is fed back as a feedback signal to the adding point 27. The driver amplifier 28 and the tachogenerator 29 thus constitute a feedback loop for controlling the rotation of the servomotor 20.

The r.p.m. of the servomotor 20 is applied by the encoder 30 as a digital signal to the arithmetic control unit 23. The arithmetic control unit 23 compares the digital signal from the encoder 30 with the signal fetched from the function generator 22 to correct a command signal (pulse signal) to the driver circuit 24 while continuing the operation of the loom 2. The amount of rotation of the servomotor 20 is thus accurately controlled under the digital feedback control.

Figure 3:
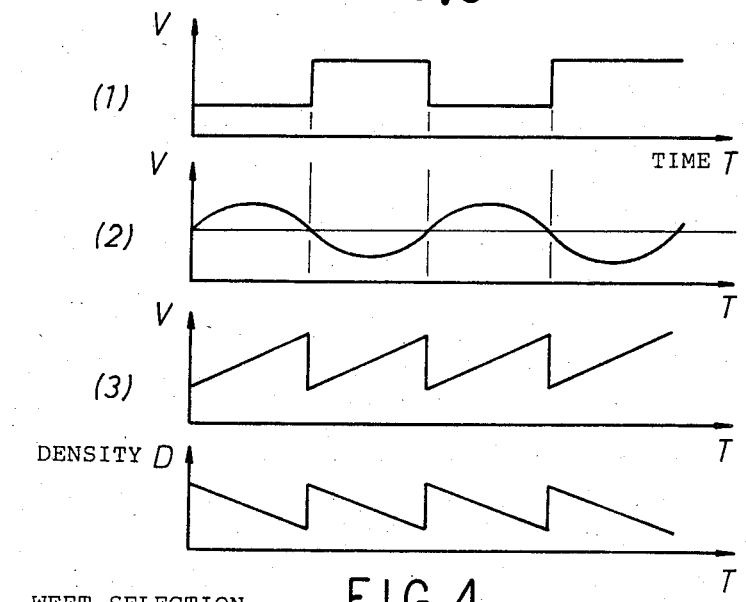
FIG. 3 is a diagram explanatory of a pattern of speeds of winding up a woven fabric.

The speed pattern for the foregoing speed control is established in the form of a rectangular wave, a sine wave, or a sawtooth wave, as shown in FIG. 3 at (1), (2), or (3). For example, where the speed pattern is of a sawtooth wave as shown in FIG. 3 at (3), the density D of weft yarn picks in the woven fabric 10 also has an oppositely directed sawtooth wave pattern. Such weft yarn density D can be established as desired based on the speed pattern stored in the function generator 22.

Variations in the weft yarn density D can be set for respective weft yarns in a multicolor loom. The weft selection command circuit 35 is responsive to multicolor weft yarns, for example, two different color weft yarns *7a, 7b,* to supply a weft selection signal A of "H" and "L" levels to the arithmetic control unit 23 based on a selected period of weft insertion. The arithmetic control unit 23 is then responsive to the variation of the level of the weft selection signal A for selectively reading a certain function from the function generator 22 to thereby produce a drive signal. Normally, the weft yarn density D is greater for the thinner weft yarn *7a,* and conversely the weft yarn density D is smaller for the thicker weft yarn *7b.*

Figure 4:
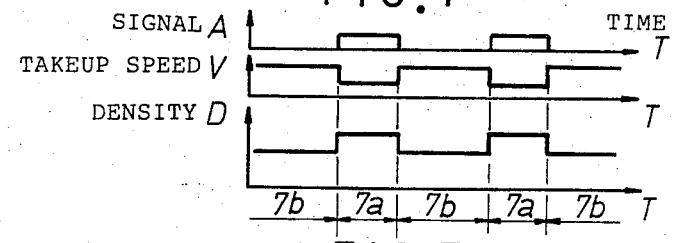
FIG. 4 is a diagram explanatory of a speed pattern for inserting two different color weft yarns.

FIG. 4 shows the relationship of the takeup speed V and the weft yarn density D in relation to the weft selection signal A of the "H" level. When the thinner weft yarn *7a* is to be inserted, the weft yarn density D is set up larger, i.e., the takeup speed V is lower, and when the thicker weft yarn *7b* is to be inserted, the weft yarn density D is set up smaller, i.e., the takeup speed V is higher. As a consequence, the fabric 10 is woven uniformly as a whole. While the case of two different color weft yarns has been described, the present invention is applicable to multicolor weft yarns. The repetitive pattern of the weft yarn density D is not limited to the rectangular wave pattern, but may be of desired wave patterns.

The foregoing description is based on the assumption that the loom 2 is under normal operating conditions, and the takeup speed V has been described in relation to the weft yarn density D of the woven fabric 10. However, the takeup motion control device 1 of the invention is effective not only in such normal operation of the loom, but also in appropriately controlling the takeup speed V under a transient condition in which the loom 2 is stopped and then restarted.

Figure 5:
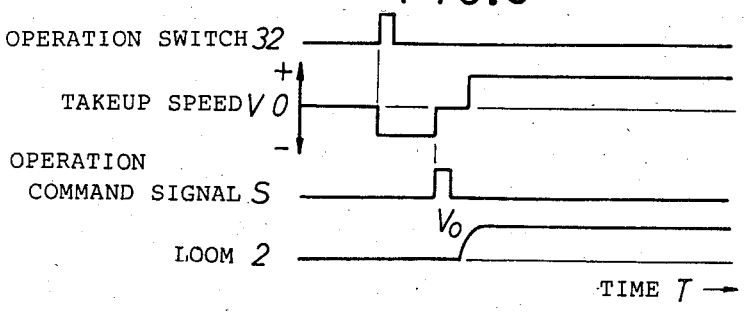
FIG. 5 is a diagram explanatory of a speed pattern at the time of restarting the loom.

FIG. 5 is illustrative of a pattern of takeup speeds V employed when restarting the loom 2. When the operation switch 32 is turned on while the loom 2 is inoperative, the arithmetic control unit 23 reads a takeup speed pattern upon restarting the loom from the function generator 22, slightly reverses the takeup motion servomotor 20 to displace the fell rearward or to the left as shown, and thereafter issues the operation command signal R of an "H" level to the loom 2 to make the loom 2 ready to restart. When an operation command signal S is applied to the loom 2 under this condition, the loom 2 now starts rotating at a normal rotational speed Vo. The amount of reversal of the fell can accurately be established by counting pulse signals from the encoder 30 coupled to the servomotor 20 within the arithmetic control unit 23. Since the fell is slightly backed off to a retracted position, a required beating force can be produced even if the reed 9 itself fails to generate a sufficient beating force at the time of an initial stage of increasing rotation of the loom 2. Accordingly, any weaving bar, particularly a stop mark, can be prevented from occuring. The positioning pattern for the fell may be selected as desired since the fell may be set to an advanced position in some looms.

The above control mode is not limited to the restarting of the loom, but may be employed for accurately returning the fell by one weft pick with respect to a single reversed revolution of the loom 2 upon pick finding. When it is desired to reverse the loom 2 for a certain number of revolutions or when the operator turns on the one-pick-return command switch 34 at the time of pick finding upon reversing of the loom for restoring the weft yarn 7, the arithmetic control unit 23 rotates the takeup motion servomotor 20 in a reverse direction for an interval corresponding to one weft pick. Since the signal from the one-pick-return command switch 34 is also applied as an input signal to the letoff motion control device 14, the letoff motion control device 14 drives the supply beam 4 in a reverse direction for an interval corresponding to one weft pick. The amount of rotation required to reverse the motor for one weft pick is determined through an arithmetic operation to find the ratio of the output from the encoder 30 to the output from the encoder 37 during operation of the loom 2. If it were not for these encoders 30, 37, then the letoff motion control device 14 would detect the diameter of the warp coil on the supply beam 4 and compute the amount of reversal required for returning the fell for one weft pick. The above loom reversing control is effected by controlling the amount of rotation at a high accuracy with the digital feedback control system, so that the fell can be set to a prescribed position effect prevention of stop marks. In the event that the amount of reversing movement for one weft pick is excessively or insufficiently achieved due to elongation of the warp yarns or frictional resistance of the loom, a required amount of rotation can be set by an input setting unit 13 associated with the letoff motion control device 14.

It has been customary in weaving for the operator to rotate the supply beam 4 and the takeup beam 13 with handles for feeding the warp yarns. In such operation, the supply beam 4 and the takeup beam 13 are required to rotate at the same speed. Since the outside diameter of the winding roll 12 is constant at all times, the amount of rotation of the letoff motion motor 15 can be determined through an arithmetic operation by establishing the coil diameter of the warp yarns 3 on the supply beam 4. By storing the speed of the motor at this time in the function generator 22, or by computing motor speeds in the arithmetic control unit 23 and applying these motor speeds to the letoff motion control device 14, the warp yarns 3 can smoothly be fed out through simple switch operation for facilitating the weaving procedure.

If the r.p.m. of the loom per unit time varies, then the speed command signal is required to be corrected in each of such variations of r.p.m. of the loom. The correction can periodically be performed by the arithmetic function of the arithmetic control unit 23. Furthermore, since the drive motor for the loom and the takeup motion servomotor 20 are separate from each other, these motors may rotate out of synchronism with each other. Should this out-of-synchronism rotation occur, the arithmetic control unit 23 successively corrects the speed command so that the count by the encoder 30 will be constant at all times during one revolution of the loom. Through this control, the weft yarn density D can be maintained constant at all times even when the r.p.m. of the loom varies.

Although a certain preferred embodiment has been shown and described, it should be understood that many changes and modifications may be made therein without departing from the scope of the appended claims.

What is claimed is:

1. A takeup motion control device for a loom which has a servomotor to drive a winding roll for winding a woven fabric, comprising:

(a) input setting unit means for introducing into said device functions of a repetitive period and a takeup speed;

(b) function unit means for storing each of said functions as a function of rotation of the loom;

(c) arithmetic control unit means for successively reading out selected functions from said function unit means in synchronism with rotation of the loom and for generating therefrom a digital takeup command signal;

(d) driver circuit means for generating a drive signal in response to said takeup command signal and for applying said drive signal to the servomotor driving the winding roll; and (e) digital feedback circuit means for feeding the amount of rotation of said servomotor back to said arithmetic control unit means as a digital feedback signal;

wherein said arithmetic control unit means is responsive to an operation command signal for reading out a fell position control signal from said function unit means and for rotating said servomotor so as to move a fell of the fabric in a direction specified by said fell position control signal.

2. A takeup motion control device for a loom which has a servomotor to drive a winding roll for winding a woven fabric, comprising:

input setting means for introducing into said device functions of a repetitive period and a takeup speed;

function means for storing each of said functions as a function of the amount of rotation of the loom;

arithmetic control means for successively reading out selected functions from said function means in synchronism with rotation of the loom and for generating in response to said selected functions a digital takeup command signal, said arithmetic control means including means responsive to a weft selection signal which selects each function to be read from said function means;

driver circuit means for generating a drive signal in response to said takeup command signal and for applying said drive signal to the servomotor driving the winding roll; and digital feedback circuit means for feeding the amount of rotation of said servomotor back to said arithmetic control means as a digital feedback signal.

3. A takeup motion control device according to claim 2, wherein said arithmetic control means includes an electric switch for electrically controlling an operation which includes one of feeding along and returning a woven fabric and warp yarn.

4. A takeup motion control device according to claim 2, wherein said arithmetic control means is responsive to an operation command signal for reading out a fell position control signal from said function means and for rotating said servomotor so as to move a fell of the fabric in a direction specified by said fell position control signal.

5. A fabric takeup device for a loom, comprising a winding roll which engages and controls movement of a woven fabric produced by the loom, selectively actuable drive means for effecting movement of said winding roll, and control unit means coupled to said drive means for controlling said drive means and movement of said winding roll in response to a weft selection signal from said loom, said control unit means having means therein containing a plurality of predetermined periodic patterns of movement for said winding roll, each said periodic pattern being defined as a function of loom movement, and said control unit means being responsive to changes in said weft selection signal for successively selecting respective said patterns and successively effecting movement of said winding roll in accord with each said selected pattern in synchronism with movement of the loom.

6. The takeup device according to claim 5, wherein each said predetermined pattern includes predetermined periodic variations in the speed of said winding roll.

7. The takeup device according to claim 5, including manually operable input setting means for facilitating introduction of said patterns into said control unit means by an operator.

8. The takeup device according to claim 5, wherein said control unit means includes and is responsive to means for sensing the movement and speed of said winding roll.

9. The takeup device according to claim 5, wherein said drive means includes a servomotor, a worm on the shaft of said servomotor, a worm gear operatively engaging said worm and drivingly coupled to said winding roll, a digital-to-analog converter responsive to an output from said control unit means, a tachogenerator operatively coupled to said servomotor, adding means for adding an output from said digital-to-analog converter and an output from said tachogenerator, and an amplifier having an input coupled to an output of said adding means and having an output connected to and controlling said servomotor.

10. The takeup device according to claim 5, wherein said control unit means includes means for causing said driving means to effect a small amount of movement of said winding roll in a reverse direction in response to a predetermined condition.

11. The takeup device according to claim 10, wherein said predetermined condition is restarting of the loom.

12. The takeup device according to claim 10, wherein said predetermined condition is the occurrence of a single reversed revolution of the loom during pick finding.

* * * * *